US011111070B2

(12) United States Patent
Bois

(10) Patent No.: US 11,111,070 B2
(45) Date of Patent: Sep. 7, 2021

(54) FLOW-LIMITING DEVICE AND CAP FOR A CONTAINER INCLUDING SAME

(71) Applicant: AIRNOV, INC., Wilmington, DE (US)

(72) Inventor: Dominique Bois, Montreuil aux Lions (FR)

(73) Assignee: AIRNOV, INC., Wilmington, DE (US)

( * ) Notice: Subject to any disclaimer, the term of this patent is extended or adjusted under 35 U.S.C. 154(b) by 0 days.

(21) Appl. No.: 16/954,706

(22) PCT Filed: Dec. 18, 2018

(86) PCT No.: PCT/EP2018/085492
§ 371 (c)(1),
(2) Date: Jun. 17, 2020

(87) PCT Pub. No.: WO2019/121680
PCT Pub. Date: Jun. 27, 2019

(65) Prior Publication Data

US 2021/0002061 A1 Jan. 7, 2021

(30) Foreign Application Priority Data

Dec. 19, 2017 (EP) ..... 17306824

(51) Int. Cl.
*B65D 41/32* (2006.01)
*B65D 47/08* (2006.01)
(Continued)

(52) U.S. Cl.
CPC ..... *B65D 83/0427* (2013.01); *B65D 41/325* (2013.01); *B65D 47/08* (2013.01);
(Continued)

(58) Field of Classification Search
CPC .. B65D 83/0427; B65D 41/325; B65D 47/08; B65D 47/127; B65D 2401/15; B65D 2583/0472
See application file for complete search history.

(56) References Cited

U.S. PATENT DOCUMENTS 4,454,962 A 6/1984 Greenspan
4,530,447 A 7/1985 Greenspan
(Continued)

FOREIGN PATENT DOCUMENTS

WO 99/48963 9/1999

OTHER PUBLICATIONS

International Search Report with Written Opinion of the International Searching Authority, dated Mar. 22, 2019, with respect to International Application No. PCT/EP2018/085492.
(Continued)

*Primary Examiner* — Anthony D Stashick
*Assistant Examiner* — L Kmet
(74) *Attorney, Agent, or Firm* — Scott R. Cox

(57) ABSTRACT

A flow-limiting device for controlling the distribution of products, to be fitted into a neck of a container for such products comprises a flow-limiting part, and a sealing part wherein the flow-limiting part consists of an active material and comprises a dispensing opening. The sealing part is made of a polymer material different to the material of the flow-limiting part. The sealing part is adapted to form a moisture-tight seal with the neck of the container.

18 Claims, 8 Drawing Sheets

(51) Int. Cl.
*B65D 47/12* (2006.01)
*B65D 83/04* (2006.01)

(52) U.S. Cl.
CPC ..... *B65D 47/127* (2013.01); *B65D 2401/15* (2020.05); *B65D 2583/0472* (2013.01)

(56) References Cited

U.S. PATENT DOCUMENTS

| | | | | |
|---|---|---|---|---|
| 5,736,616 | A | 4/1998 | Ching et al. | |
| 2007/0034630 | A1 | 2/2007 | Lancesseur et al. | |
| 2007/0267304 | A1 | 11/2007 | Portier | |
| 2009/0308868 | A1* | 12/2009 | Portier | B65D 83/0427 220/200 |
| 2015/0053579 | A1 | 2/2015 | Lebon et al. | |
| 2017/0144804 | A1 | 5/2017 | Bois et al. | |
| 2020/0269538 | A1* | 8/2020 | Michaud | B32B 27/36 |

OTHER PUBLICATIONS

International Preliminary Report on Patentability of the International Searching Authority, dated Dec. 4, 2019, with respect to International Application No. PCT/EP2018/085492.

* cited by examiner

FLOW-LIMITING DEVICE AND CAP FOR A CONTAINER INCLUDING SAME

FIELD OF THE INVENTION

The invention relates to a flow-limiting device for controlling the distribution of products, to be fitted into a neck of a container for such products. Further, the invention relates to a cap for a container for storing and dispensing products, and a container.

BACKGROUND OF THE INVENTION

Prescription drugs, diagnostic products or food supplements in the form of tablets, dragees, pills, lozenges, granules, pastilles or capsules are often loosely packaged in containers with a cylindrical shape and an openable cap for closing and sealing the container opening. To increase the ease of handling, flow-limiting devices may be provided which may be integrally molded or may be used as an insert filling the container opening. Such flow-limiting devices reduce the number of unitary products distributed on one time. Ideally, flow-limiting devices only allow the transition of one single unitary product, e.g. one tablet at a time.

US 2009/0308868 A1 describes such a flow-limiting device to be fixed in a container opening of a container body. In order to provide good sealing properties, the flow-limiting device is provided with a seal and inserted into a container cap. The combination of the sealed flow-limiting device and the container cap is put on or into a container body so that the seal is sealed against the container body.

The sealed assembly for storage and distribution of solid loosely packed products according to US 2007/0267304 A1 comprises a storage container, a sealing means and a flow-limiting device inserted into the neck of the container to permit the passage of the products to be distributed. Inviolability and sealing of the container are achieved by means of a peelable heat seal, which is thermally sealed into the neck of the container or on all or part of an upper surface of the flow-limiting device.

There is an increasing need for a packaging that can be adapted on bottles, in particular plastic or glass bottles, and which, besides the distribution function, is able to increase the shelf life of substances which are sensitive to moisture, oxygen of other gases.

DESCRIPTION OF THE INVENTION

Accordingly, it is the object of the invention to design a flow-limiting device which can be adapted on bottles, such as plastic or glass bottles, and can increase the shelf life of suitable products which are sensitive to moisture, oxygen or other gases.

This object is solved by a flow-limiting device with the features of claim 1, a combined cap for a container for storing and dispensing products, comprising such a flow-limiting device attached to a cap, with the features of claim 9, and a container for storing and dispensing products comprising such a combined cap with the features of claim 14. Finally, the subject is solved by the use of such a container for storing the specific products according to claim 16.

The inventive flow-limiting device for controlling the distribution of preferably unitary products, to be fitted into a neck of a container for such unitary products, comprises a flow-limiting part and a sealing part, wherein the flow-limiting part consists of an active material and comprises a dispensing opening, whereas the sealing part is made of a polymer material different to the material of the flow-limiting device. The sealing part is adapted to form a moisture-tight seal with the neck of the container. The sealing part is injection molded. The flow-limiting part and the sealing part can be preassembled or integrally formed.

The active material is a material able to act on its surrounding atmosphere. For example by decreasing or increasing relative humidity, by scavenging oxygen, by trapping or releasing odors or organic volatile compounds. It comprises at least one treatment agent that can be blended into at least one polymer, preferably a plastic.

Such flow-limiting device can overcome the problem generally encountered with active materials, like desiccant entrained polymers, which, combined with a rigid bottle, do not have a sufficient impermeability to moisture and sufficient elasticity and flexibility in order to provide satisfactory sealing properties. The inventive-flow limiting device solves the problem with an integrally formed piece which comprises a flow-limiting part and a sealing part made of different materials. In such a way, the flow-limiting device according to the invention combines in a preferably integrally formed part three different functions. Firstly, it provides a sealing (air-tight or moisture-tight) function against the mouth of the container. Secondly, it provides the desired flow-limiting function for dispensing the products. Thirdly, its active material supports the maintenance of a desired gaseous atmosphere within the container. As a further function, the limiting device can also be provided with a tightening part which serves to affix the flow-limiting device to the dispensing mouth of a container.

When reference is made to a container, it should be understood that this term also covers bottles or flasks or other geometries which can be used for products, preferably unitary products, and especially pharmaceutical substances or food additives.

Products can be, for example, pharmaceutical, cosmetic, nutritional, veterinary or diagnostic products. In the case of pharmaceutical products, these can be tablets, dragees, pills, lozenges, pastilles, granules, powder or capsules.

Preferably, the flow-limiting part and the sealing part are integrally formed. More preferably, the flow-limiting part and the sealing part of the flow-limiting device are formed by bi-injection molding. In such a way, the flow-limiting part and the sealing part can be integrally formed from different materials. First, the limiting part can be molded with an active material. Then, in the same mold still containing the molded limiting part, the sealing part is molded. Alternatively, the molded limiting part can be transferred into a second mold to be over-molded with a second material realizing sealing part. Alternatively, the sealing part can be molded first, and the limiting part second.

Preferably, the sealing part is adapted to be at least partially inserted into the neck of the container.

The sealing part may be provided with an annular sealing member which is arranged so as to establish a sealing contact with the neck of the container to which the inventive flow-limiting device is adapted to be fitted. The annular sealing member can be arranged such as to establish a sealing contact around the outer circumference of the neck of the container. Preferably, the annular sealing member is arranged such as to establish a sealing contact around the inner circumference of the neck of the container.

According to a preferred embodiment, the sealing part comprises an annular sealing member adapted to form a moisture tight seal with an interior surface of the neck of the container. The annular sealing member is preferably provided with an annular bead close to its distal end, the annular bead extending in a radially outwards direction. In this context, the distal end is defined to be that which, when the flow-limiting device is mounted on a container, extends into the neck of the container.

The provision of an annular sealing member with an annular bead has the advantage that the sealing function of the sealing part can be improved. An annular bead will establish a contact area between the sealing part and the neck of a container which is close to a line contact. A line contact is advantageous in that surface irregularities and manufacturing tolerances can more easily be absorbed by the elasticity of the sealing part, because the smaller the contact area between the sealing part and the neck of the container is, the higher will be the pressure and the elastic deformation of the sealing part at the contact region.

The sealing part can comprise an annular skirt adapted to be connected to the neck of the container. This annular skirt allows a better holding of the flow-limiting device on the neck of the container. Preferably, in the mounted state, the annular skirt runs around the outer circumference of the neck of the container. The annular skirt can be adapted to be snap-fitted on the neck of the container. The annular skirt can be provided with an interlocking bead which projects in a radially inwards direction. The interlocking bead is adapted to fix to the neck of the container. Alternatively, the annular skirt may be provided with a thread to be screwed over the neck of the container. The annular skirt can be adapted to form a moisture-tight seal with the neck of the container.

Preferably, the annular skirt is provided further to the annular sealing member, and is arranged concentrically and radially outwards relative to the annular sealing member. Such annular skirt can have two functions. Firstly, by appropriately dimensioning the radial gap between the annular skirt and the annular sealing member, the neck of a container can be fitted into such gap so that the sealing pressure (or holding forces) between the neck of the container and the annular sealing member can be increased. The second function is a possible interlocking function between the annular skirt and the neck of the container. Such interlocking can be realized by means of a form fit connection with interlocking hooks around the outer circumference of the neck of the container and the inner circumference of the annular skirt. When the flow-limiting device is fitted into and onto a neck of a container, the hooks will interlock and generate a permanent form fit connection so that the flow-limiting device can no longer be removed from the neck of the container.

Optionally, the annular skirt provided with the interlocking bead acts as a further sealing means in addition to the sealing contact between the annular sealing member and the neck of the container.

According to a preferred embodiment, the sealing part further comprises a sealing ring which is arranged and adapted to establish a moisture-tight seal with a cap for closing the container. In this manner, during storage of the container and the products stored therein, no undesired moisture can enter the assembled container. This extends the shelf life of a container provided with the inventive flow-limiting device and a cap. The sealing ring is preferably arranged and adapted to be snap-fitted into the cap. Such sealing ring is preferably arranged at a proximal end of the flow-limiting device. The snap-fit can be provided by means of protrusions.

Preferably, the flow-limiting part is provided with a plurality of elevated regions, preferably ribs, providing overall surfaces slanted towards the dispensing opening. The elevated regions have an elevation in an axial direction of the flow-limiting device. The slanted surfaces of the elevated regions are adapted to guide the products towards the dispensing opening. The arrangement of the elevated regions and their geometries are selected such that the unitary products cannot enter the recessed spaces between the elevated regions. Therefore, the geometry of the elevated regions and especially the spacing between them will have to be designed in view of the unitary products to be stored in the container. The ribs can extend in a radial direction. Further, the ribs can serve to reinforce the flow-limiting part.

Preferably, the dispensing openings are arranged offset relative to the radial center of the flow-limiting device.

Such offset arrangement of the dispensing opening can be conveniently arranged between radially extending ribs.

The inventive combined cap for a container for storing and dispensing products comprises a flow-limiting device according to the invention and a cap comprising a closure element, wherein the flow-limiting device is attached to the cap. Such arrangement has the advantage that the cap and the flow-limiting device can be combined or preassembled and the resulting combined cap only will have to be attached to the neck of a container after it has been filled with the products. The combined cap is arranged such that, in use, the closure element is openable while the flow-limiting device remains fixed to the neck of the container. As used herein, the cap is the part to which the flow-limiting device is attached to form the combined cap. The cap comprises a removable closure element which can be removed in order to gain access to the dispensed products.

The cap with its closure element can be integrally molded with the flow-limiting device, for example when the cap is a flip-top cap connected to the flow-limiting device by a film hinge.

Alternatively, the combined cap can comprise two or even more separate pieces, for example when the flow-limiting and the cap are molded separately and then assembled together.

Preferably, the combined cap comprises a tamper-evident means, preferably comprising at least one tearable or frangible element. The combined cap comprising the flow-limiting device and the cap thus has the additional advantage to be additionally provided with a tamper-evident means which, before the first use of the container, will have to be broken so that there is a clear indication to a user that the cap has already been opened before. More preferably, the tamper-evident means is provided on the cap. It can for example be integrally molded with the closure element.

The closure element of the cap according to a further preferred embodiment comprises a top plate and an annular sealing skirt depending therefrom, wherein the sealing skirt is shaped and arranged to form a moisture-tight seal with a sealing ring of the flow-limiting device.

According to a further embodiment, the closure element comprises a peripheral wall extending downwardly from the top plate and situated radially outside of the annular sealing skirt.

According to a further embodiment, the closure element comprises a reservoir for receiving a dispensed unitary product. The reservoir is preferably delimited by the top plate and the annular sealing skirt. Such cap with a flow limiting device can be used to dispense one single product at a time simply by turning the container upside down so that one single product will pass the dispensing opening of the flow-limiting part and fall into the reservoir. Upon opening of the cap, the single product within the reservoir can easily be administered. Another field of application is the extraction of granules which are dispensed into the reservoir of the cap.

The use of a reservoir has the additional advantage that a product once dispensed can easily be returned into the container. This is necessary in case that a user dispensed a pharmaceutical product and realized that, according to the prescription, it has to be taken at some other time of the day. Further, in case that a user inadvertently dispensed two products at one time, they are safely kept in the reservoir and can easily be returned through the dispensing opening back into the container.

Preferably, the combined cap further comprises a hinge for hingedly opening at least a part of the closure element of the cap. Such hinge can be a film hinge. The hinge has the advantage that, when opening the container, the closure element of the cap cannot become misplaced and lost. The hinge can connect the closure element to another part of the cap, such as for example a ring which remains attached to the neck of the container.

According to another embodiment, the hinge can connect the closure element of the cap to the sealing part of the flow-limiting device. More particularly, the hinge can be integrally molded with the sealing part of the flow-limiting device. It has the advantage that the cap, comprising the closure element and the hinge, can be integrally molded with the sealing part of the flow-limiting device.

The inventive container for storing and dispensing unitary products comprises an openable combined cap according to the invention, and a container body with a container opening to which the combined cap is mounted, wherein the combined cap is provided with a flow-limiting device with a dispensing opening which is dimensioned to allow the passage of one unitary product at a time.

The combined cap is adapted to form a moisture tight seal with the neck of the container.

A moisture tight seal means that the overall moisture ingress of the container measured with the combined cap assembled on the container body does not differ by more than 0.5 mg/day from the moisture ingress measured on the container body sealed with an aluminum lidding foil, the moisture ingress being measured at 40° C., 75% RH using instructions of ASTM D7709.

When the active material comprises a desiccant, the relative humidity inside the container closed by the combined cap of the invention is able to keep the relative humidity inside the container below 50% during a time period of more than 2 years, preferably more than 3 years when the closed container is stored in a climatic chamber set at 30° C., 65% RH.

When the active material comprises an oxygen scavenger, oxygen level inside the container closed by the combined cap of the invention is able to keep the oxygen concentration inside the container below 5% during a time period of more than 2 years, preferably more than 3 years when the closed container is stored in a climatic chamber set at 30° C., 65% RH at room concentration for oxygen.

When the active material comprises a combination of a desiccant and an oxygen scavenger, both conditions disclosed above are maintained.

Preferably, the container opening is surrounded by a lip forming the neck of the container. The lip is shaped to allow a snap-fit connection with either the cap or the flow-limiting device.

The use of the container is for storing and dispensing diagnostic products, tablets, dragees, pills, lozenges, pastilles, granules or capsules. Such products are often sensitive to the existence of undesired gaseous components within the interior atmosphere of the container so that for those specific products, it is specifically useful to provide an inventive container which is able to dispense the unitary products and to provide both an extended shelf life during storage and an extended use when repeatedly opening the container.

BRIEF DESCRIPTION OF THE DRAWINGS

In the following, some specific embodiments of the invention will be described with reference to the drawings in which.

DESCRIPTION OF PREFERRED EMBODIMENTS

Figure 1:
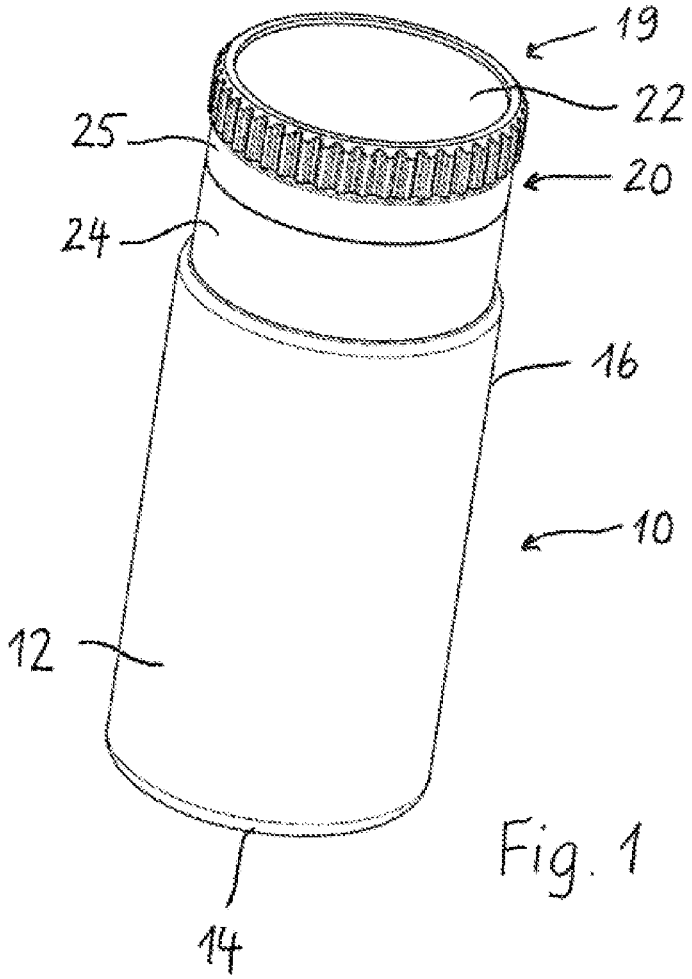
FIG. 1 shows a closed container according to a first embodiment of the invention.

Throughout the description below of preferred embodiments of the invention, the same elements will be indicated by the same reference numerals.

When reference is made to geometrical relationships like upper or lower, a container with the flow-limiting device according to the invention is considered to stand on a flat horizontal surface so that the opening of the container faces in an upward direction. If a container of different shape and with a dispensing opening which is angularly arranged with respect to a vertical direction should be used, the terminology can be adapted accordingly.

The container 10 as shown in FIG. 1 has a container body 12 which, in the example as shown in FIG. 1 has a substantially cylindrical shape with a bottom wall 14 and a cylindrical sidewall 16. However, the container body 12 could also have a different geometrical shape, although it is preferred that the neck 18 (see FIG. 2) of the container body has a cylindrical shape.

Further, a combined cap 19 is provided which comprises a flow-limiting device 24 attached to a cap 20 having a closure element 22. Further, in order to provide tamper-evident characteristics to the container 10, a tamper-evident means can be provided which, in the example of FIG. 1 is provided as breakable bridges between the closure element and the ring 25 which, in case that the bridges have been broken, indicates to a user that the cap has been opened before.

Figure 2:
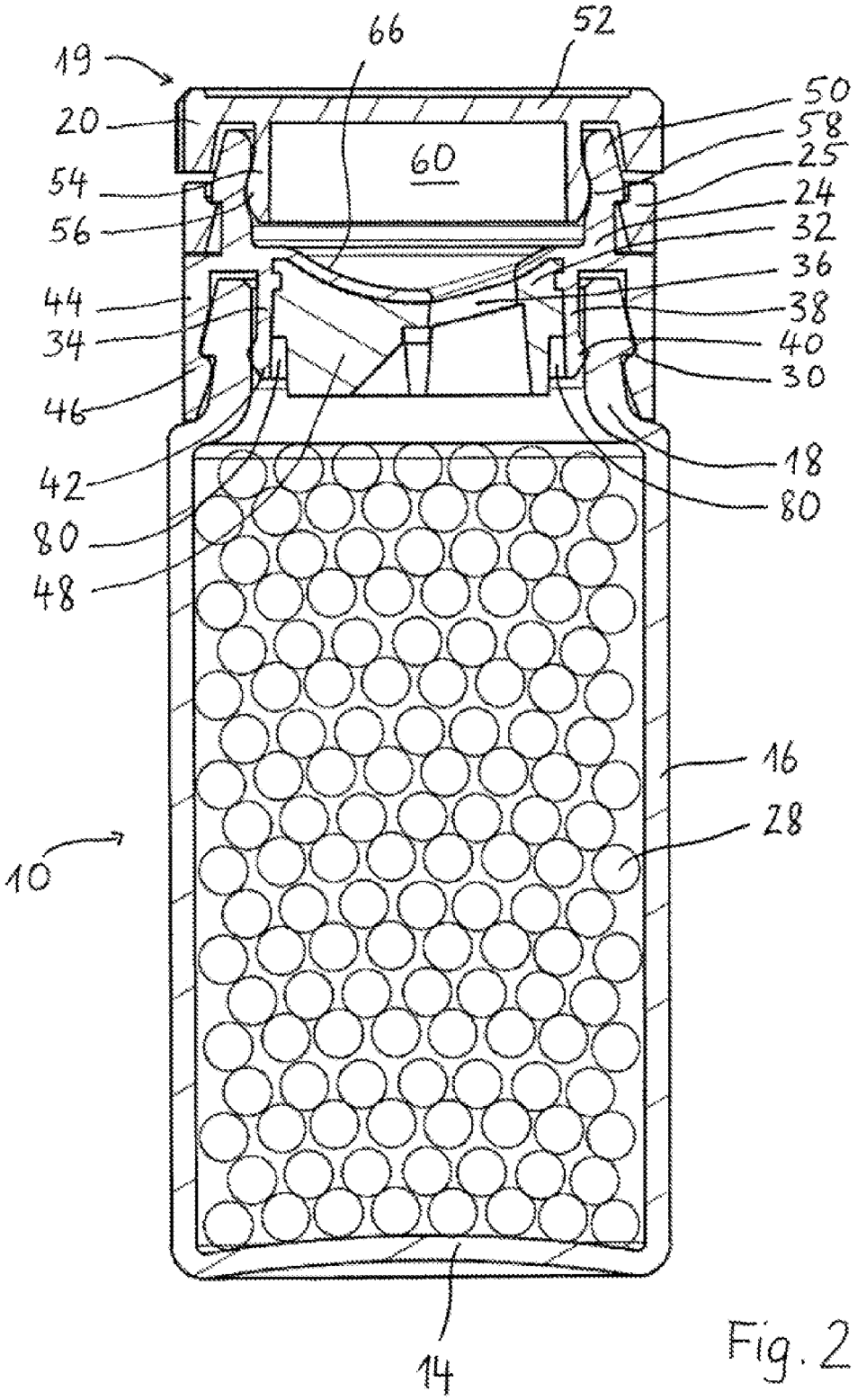
FIG. 2 is a cross-sectional view of the container according to FIG. 1.

Turning now to FIG. 2, the container 10 containing the unitary products 28 in its interior is shown in a cross-sectional view. The sidewall 16 of the cylindrical container narrows in an upwards direction to a neck 18 of the container which is provided with an outwardly facing step portion 30 which runs around at least part of the outer circumference of the neck 18.

In the assembled state, the flow-limiting device 24 is attached to the neck 18 of the container. The flow-limiting device 24 comprises a flow-limiting part 32 and a sealing part 34.

The flow-limiting part 32 is provided with a dispensing opening 36 which is provided offset to the longitudinal center line of the container. The sealing part 34 is provided with an annular sealing member 38 which is arranged so as to establish a sealing contact around the inner circumference of the neck 18. The annular sealing member 38 can be provided with an annular bead 40 which is close to the distal end 42 of the annular sealing member 38 and which extends in a radially outwards direction of the annular sealing member 38. The annular bead 40 abuts and presses against the inner circumference of the neck 18 so as to establish a sealing contact between the sealing part 34 of the flow-limiting device 24 and the neck 18 of the container.

The flow-limiting device 24 is advantageously provided with an empty space 80 between the sealing member 38 and the flow-limiting part 32 close to and extending up to the distal end 42 of the annular sealing member 38. Such empty space 80 allows the distal end of the sealing member 38 to be elastically bent in a radially inwards direction when assembled onto the neck of the container. The possibility to compensate the elastic bending of the annular sealing member 38 allows to design the geometry of the annular bead 40 such that even in view of possible manufacturing tolerances, the annular bead 40 will always press with a sufficient force against the neck of the container such that a good air tightness can be safely establish.

Additionally, the sealing part 34 of the flow-limiting device 24 is provided with an annular skirt 44 which is arranged concentrically relative to the annular sealing member and radially outwards thereof. The annular skirt 44 is arranged so that in the mounted state as shown in FIG. 2, the annular skirt 44 runs around the outer circumference of the neck 18.

The annular skirt 44 is provided with a hook 46 which is an interlocking bead projecting in a radially inwards directions and which is arranged at a position such that, in the mounted state, the hook 46 establishes a form fit connection with the step portion 30 of the neck 18. In addition to this, the annular skirt 44 and the abutting contact between its hook 46 and the step portion 30 of the neck 18 can establish a further sealing contact around the outer circumference of the neck of the container. In this way, a double sealing contact both on the inner circumference and on the outer circumference of the neck 18 can be established. It should be noted that, as shown in FIG. 2, the outer sealing contact and the inner sealing contact can be arranged at substantially the same height position which further increases the sealing effect by tightening the seals.

The flow-limiting device 24 is further provided with radially extending ribs 48 (shown in FIG. 2 and FIG. 4) which form part of the flow-limiting part 32. These ribs form slanted surfaces 64 (see FIG. 5) allowing to direct the unitary products towards the opening.

The flow-limiting device 24 is further provided with a sealing ring 50 which is arranged and adapted to form a moisture-tight seal with the cap 20, and more particularly with the removable closure element 22 of the cap 20. Furthermore, the sealing ring 50 is arranged and adapted to be snap-fitted into the cap 20. More particularly, this sealing ring allows to fix or hold the closure element 22.

The closure element 22 comprises a top plate 52 and an annular sealing skirt 54 depending therefrom. The annular sealing skirt 54 is shaped and arranged to form a moisture-tight seal with the sealing ring 50 of the flow-limiting device 24. It is arranged such that it presses against the inner circumference of the fixing ring 50. Preferably, the annular sealing skirt 54 is provided with an outwardly extending circular protrusion 56 which snap-fits into a correspondingly shaped depression 58 on the inner circumference of the sealing ring 50. The sealing relation between protrusion 56 and groove 58 can be for example as described in US2017/144804 the disclosure of which is included by reference.

The annular sealing skirt 54 and the top plate 52 form a cavity 60 which can be used as a reservoir for collecting the dispensed unitary products.

The cap is further provided with a tamper-evident means which, in the embodiment as shown in FIG. 2, is provided as breakable bridges 62 (shown in FIG. 3) between the closure element 22 and the ring 25. The cap 20 comprising the closure element 22, the ring 25 and the breakable bridges is integrally molded.

The flow-limiting device 24 is bi-injection molded from two different materials. The flow-limiting part 32 is made of an active material and the sealing part 34 is made of plastic material with sufficient flexibility and elasticity in order to establish a press-fit or a snap-fit connection with the neck 18 of the container and to establish a sealing (moisture-tight) contact with the container on one hand and with the closure element 22 on the other hand.

The active material forming the flow limiting part is a material able to act on its surrounding atmosphere. For example by decreasing or increasing relative humidity, scavenging oxygen, trapping or realizing odor and organic volatile compounds. It comprise at least one treatment agent that can be blended into at least one plastic material.

The flow-limiting part 32 is made of a suitable plastic material which is preferably selected from the group comprising branched or linear high and low density polyethylenes, copolymers of ethylene such as for example ethylene vinyl acetates, ethylene ethyl acrylates, ethylene butyl acrylates, ethylene maleic anhydrides, ethylene alpha olefines, regard-less of the methods of polymerisation or modification by grafting, homo polypropylene and copolymers, polybutene-1, polyisobutylene. Polyolefines are preferably selected to make the flow-limiting part 32 for cost reasons and because they are easy to use.

Other polymer materials can be considered however such as polyvinyl chloride, copolymers of vinyl chloride, polyvinylidene chlorides, polystyrenes, copolymers of styrene, derivatives of cellulose, polyamides, polycarbonates, polyoxymethylenes, polyethylene terephthalates, polybutylene terephthalates, copolyesters, polyphenylene oxides, polymethyl methacrylates, copolymers of acrylate, fluoride polymers, polyphenylene sulphides, polyarylsulphones, polyaryletherketones, polyetherimides, polyimides, thermoplastic elastomers, polyurethanes, phenol resins, melamine resins, urea resins, epoxy resins and unsaturated polyester resins, elastomers.

Biodegradable polymer materials, with for example a starch base, are also possible such as polylactic acids (PLA).

Combinations of these polymers can be used, if desired. The polymer used to produce the body of the flow-limiting part 32 can also contain one or more additives such as elastomers, fibers, expanding agents, additives such as stabilizers and colorants, sliding agents, demolding agents, adhesion agents or reinforced catching agents and/or any others according to the requirements of usage.

The flow-limiting part 32 can also be made from injectable materials made in such a way that they are capable of absorbing various different pollutants such as humidity, oxygen, odour and other possible pollutants. The thermoplastic materials are thus themselves formulated with treatment agents belonging to a group of humidity absorbers, oxygen scavengers, odour absorbers and/or emitters of volatile olfactory organic compounds. The formulated thermoplastic materials must however retain a certain degree of resilience.

Suitable treatment agents to control humidity are selected from a group comprising silica gels, dehydrating clays, activated alumina, calcium oxide, barium oxide, natural or synthetic zeolites, molecular or similar sieves, or deliquescent salts such as magnesium sulfide, calcium chloride, aluminum chloride, lithium chloride, calcium bromide, zink chloride or the like. Preferably the dehydrating agent is a molecular sieve and/or a silica gel. A suitable oxygen collecting agent is selected from a group comprising metal powders having a reducing capacity, in particular iron, zink, tin powders, metal oxides still having the ability to oxidize, in particular ferrous oxide, as well as compounds of iron such as carbides, carbonyls, hydroxides, used alone or in the presence of an activator such as hydroxides, carbonates, sulfites, thiosulfates, phosphates, organic acid salts, or hydrogen salts of alkaline metals or alkaline earth metals, activated carbon, activated alumina or activated clays.

Other agents for collecting oxygen can also be chosen from specific reactive polymers such as those described for example in the patents U.S. Pat. No. 5,736,616 and WO 99/48963. These specific reactive polymers can be mixed with a thermoplastic polymer used to produce the flow-limiting device according to the present invention.

The amount of treatment agent introduced into the thermoplastic polymer to produce the flow-limiting part of the flow-limiting device according to the present invention expressed in percentage by weight can advantageously be more than 40%, preferably more than 50% of the thermoplastic material used to produce the flow-limiting device, when the treatment agent is a reaction and/or adsorption agent.

The material of the container can be freely selected. For example, the container body and the integrally formed neck thereof can be made of glass or suitable plastic material.

The flow-limiting part 32 of the flow-limiting device 24 is made from an active material. Examples of active materials are given above.

The sealing part 34 of the flow-limiting device 24 is made of a plastic material provided with a sufficient impermeability to moisture and sufficient elasticity and deformability so as to allow moisture-tightness with both the container and the cap.

The cap 20 of the container is also suitably made of plastic material which is provided with a sufficient elastic deformability so as to form an air-tight connection to the sealing ring 50 of the flow-limiting device.

Figure 3:
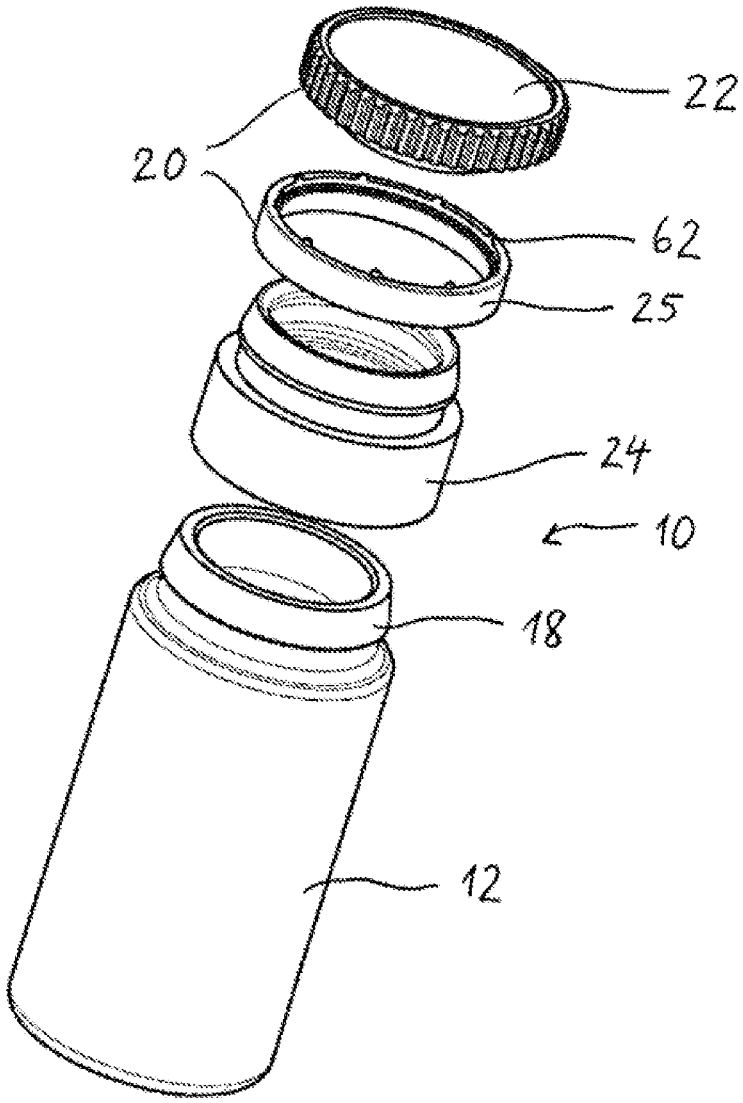
FIG. 3 is an exploded assembly drawing of the container according to FIG. 1.

FIG. 3 shows in an exploded view the individual parts of the container assembly 10 including the container body 12 with a neck 18, the flow-limiting device 24 and the cap 20 comprising the closing element 22 and the ring 25 on which the breakable bridges 62 can be seen. The cap 20 is molded in one piece. For example, the cap 20 can be integrally molded in one plastic material or bi-injection molded with two different materials, for example to provide soft or rough aspects, parts with different colors.

Figure 4:
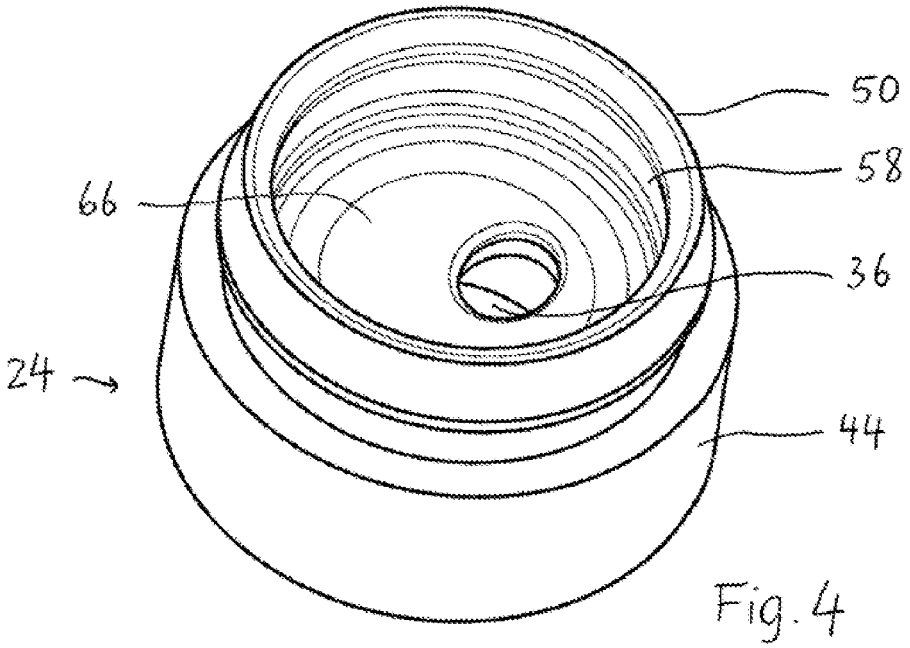
FIG. 4 is a top perspective view onto a flow-limiting device of the first embodiment of the invention.
Figure 5:
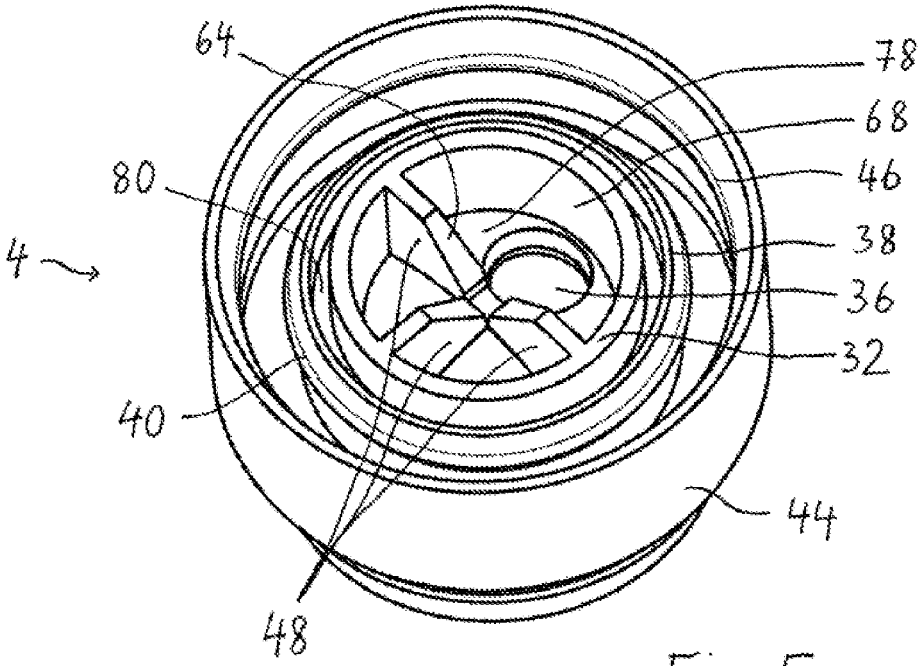
FIG. 5 is a bottom perspective view onto the flow-limiting device according to the first embodiment of the invention.

In FIG. 4, a perspective top view onto the flow-limiting device and in FIG. 5 a perspective bottom view on the flow-limiting device are shown.

In FIG. 4, the sealing ring 50 with its depression 58 and the outer circumferential surface of the annular skirt 44 can be seen. Further, a concave surface 66 is shown which can also be seen in the cross-sectional view of FIG. 2. The concave surface 66 helps to redirect products which were inadvertently dispensed back through the dispensing opening 36 and into the interior volume of the container. Furthermore, the concave surface 66 comprises a layer of polymer material which is different to the active material and which is molded with the sealing part.

In FIG. 5 showing the bottom side of the flow-limiting device, the shape of the ribs 48 can be seen. The ribs have guiding surfaces 64 which help, when turning the container upside down, to guide the unitary products inside the container towards the dispensing opening 36.

Further, the shape of the flow-limiting part 32 can be more clearly seen. The flow-limiting part 32 essentially consists of a ring 68, a surface 78 (opposed or on the other side compared to the concave surface 66) and the ribs 48 being integrally formed with the ring 68 and the surface 78. The surface 78 is convex in the embodiment shown but can also be flat or concave.

The embodiment as shown in FIGS. 6 to 10 is very similar to the embodiment as previously explained so that reference will be made in the following mainly to the differences to the embodiment according to FIGS. 1 to 5. The flow-limiting device 24 comprises a flow-limiting part 32 and a sealing part 34, preferably integrally formed by bi-injection molding. The flow-limiting device 24 is assembled into a cap 20 provided with a closure element 22. The cap 20 further comprises a ring part 84 and a tamper-evident means between the closure element 22 and the ring part 84.

Figure 6:
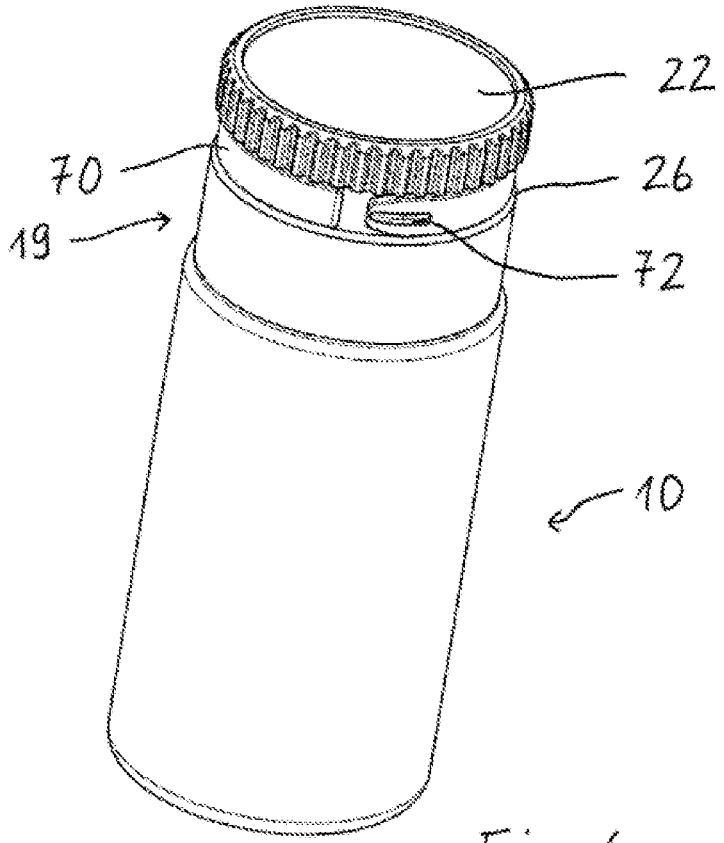
FIG. 6 shows a closed container according to a second embodiment of the invention.
Figure 7:
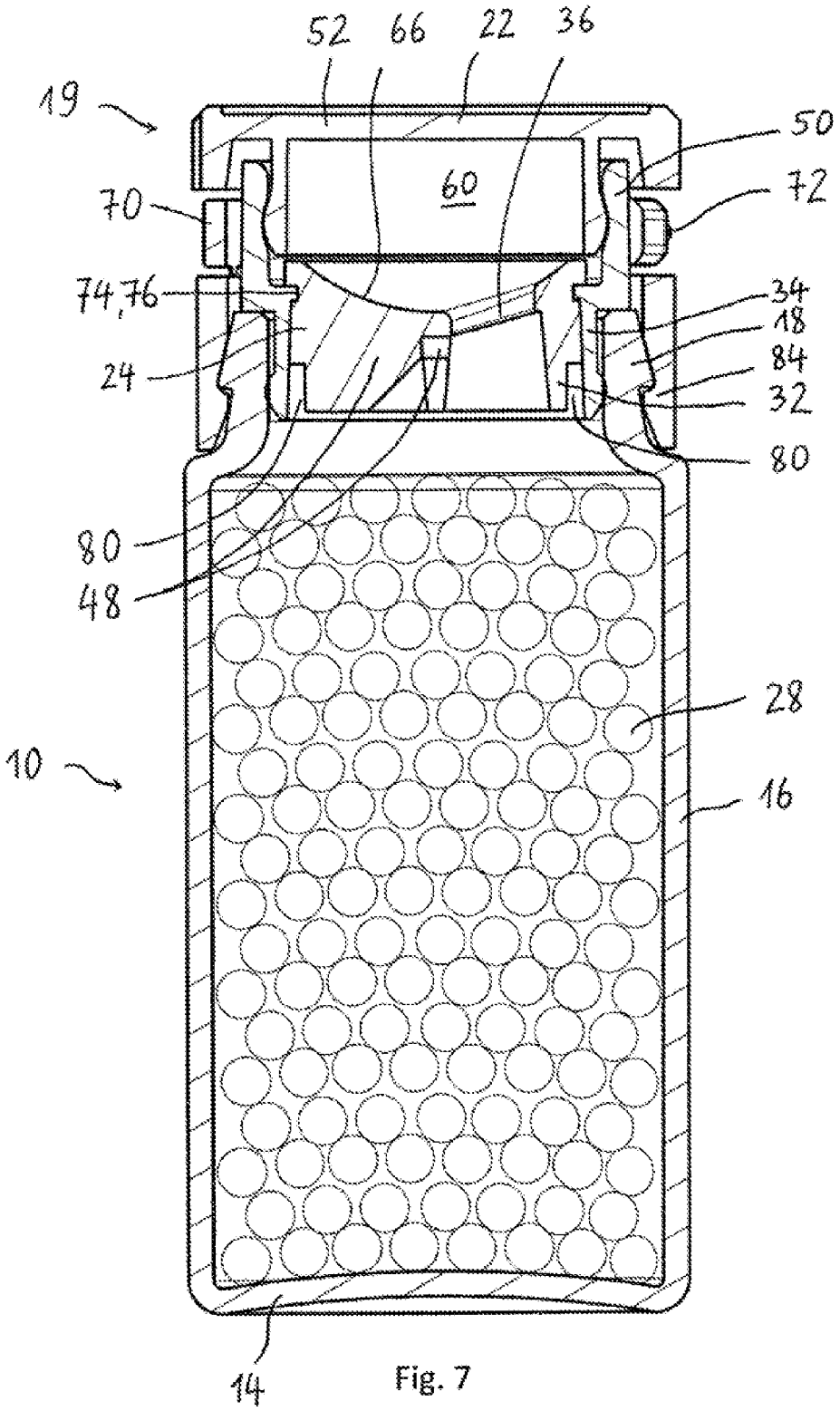
FIG. 7 is a cross-sectional view of the container according to FIG. 6.
Figure 8:
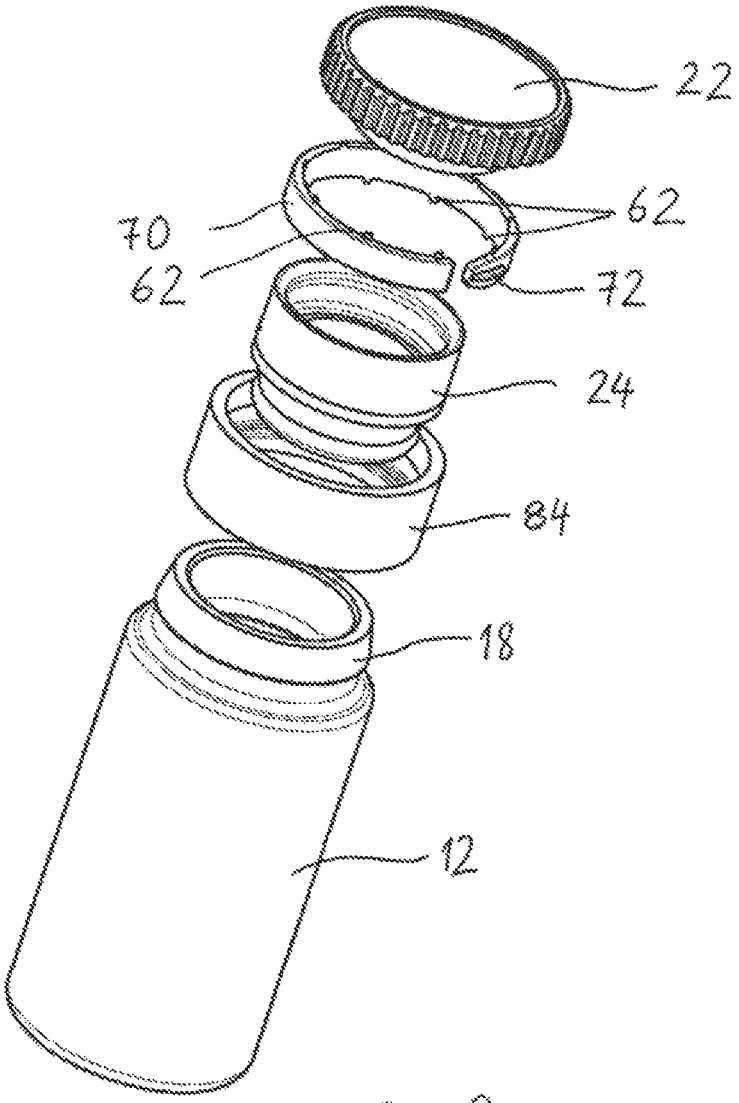
FIG. 8 is an exploded assembly drawing of the container according to FIG. 6.
Figure 9:
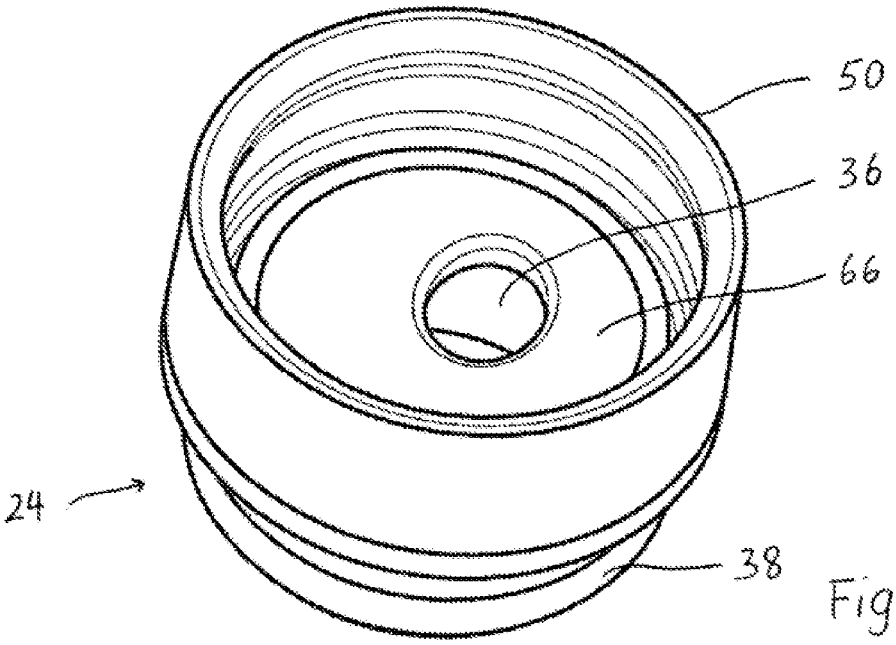
FIG. 9 is a top perspective view onto a flow-limiting device of the second embodiment of the invention.
Figure 10:
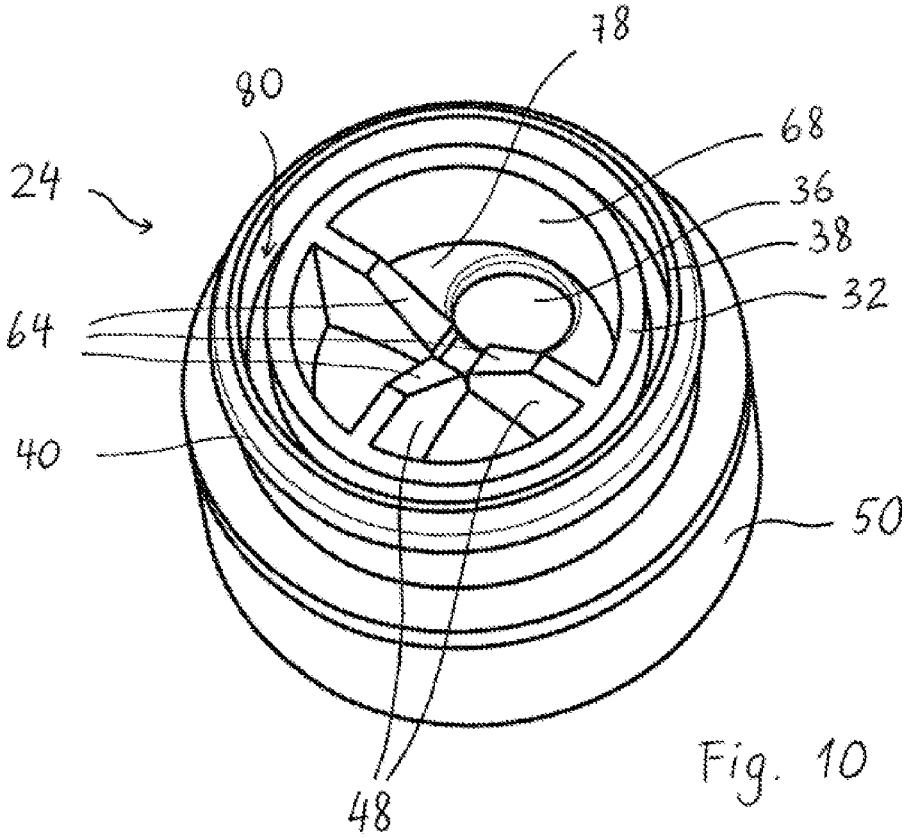
FIG. 10 is a bottom perspective view onto the flow-limiting device according to the second embodiment of the invention.

In the embodiment according to FIG. 6, the tamper-evident means 26 is provided as a tearable band 70 with a tab 72 which is grasped by the user before first opening the container in order to remove the tearable band 70. The tamper-evident means is further provided with breakable bridges 62 (shown in FIG. 8). Alternatively, these breakable bridges can be replaced by a thickness reduction in the material of the cap.

The cap 20, comprising the closure element 22, the ring part 84 and the tamper-evident band 70 is integrally formed in one piece.

Further, like in the embodiment as shown in FIGS. 1 to 5, the flow-limiting part 32 and the sealing part 34 are preferably integrally formed. This is achieved by means of a protrusion 74 which extends from the inner circumferential surface of the sealing part 32 in a radially inwards direction and fits into a circumferential notch 76 arranged on the outer circumference of the flow-limiting part 32. In this way, it is possible to design a flow-limiting device that combines an active substance while being flexible for sealing purposes. Alternatively, the flow-limiting part 32 and the sealing part 34 could be molded separately and then assembled. In this case, they can be provided with a snap-fit connection, as interlocking protrusions. This allows to maintain both parts of the flow-limiting device assembled.

The flow-limiting device 24 can be manufactured by bi-injection molding with two different types of material. First, the flow-limiting part 32 made of an active material is molded followed by molding of the sealing part 32.

The flow-limiting device 24 and the cap including the tamper-evident means can be preassembled so that, at the site where the unitary products are packaged they simply have to be filled in the interior volume of the container before snapping the combined flow-limiting device, cap and tamper-evident means onto the neck of the container.

The invention claimed is:

1. A flow-limiting device for controlling the distribution of products, to be fitted into a neck of a container for such products, the flow-limiting device comprising:

a flow-limiting part; and a sealing part;

wherein the flow-limiting part is made of an active material and comprises a dispensing opening;

wherein the sealing part is made of a polymer material different to the material of the flow-limiting part; and wherein the sealing part is adapted to form a moisture-tight seal with the neck of the container;

wherein the sealing part is injection molded; and the flow-limiting part and the sealing part are integrally formed by bi-injection moulding.

2. The flow-limiting device according to claim 1, wherein the sealing part comprises an annular sealing member which is arranged so as to establish a sealing contact around the circumference of the neck of the container.

3. The flow-limiting device according to claim 1, wherein the sealing part comprises an annular sealing member adapted to form a moisture-tight seal with an interior side of the neck of the container, wherein the annular sealing member is provided with an annular bead close to its distal end, the annular bead extending in a radially outwards direction.

4. The flow-limiting device according to claim 1, wherein the sealing part comprises an annular skirt adapted to be snap-fitted on the neck of the container.

5. The flow-limiting device according to claim 4, wherein the annular skirt comprises an interlocking bead which projects in a radially inwards direction.

6. The flow-limiting device according to claim 1, wherein the sealing part comprises a sealing ring which is arranged and adapted to establish a moisture-tight seal with a cap for closing the container, the sealing ring arranged and adapted to be snap-fitted into the cap.

7. The flow-limiting device according to claim 1, wherein the flow-limiting part further comprises a plurality of elevated regions, providing overall surfaces slanted towards the dispensing opening of the flow-limiting part.

8. The flow-limiting device according to claim 1, wherein the dispensing opening is arranged offset relative to a radial center of the flow-limiting device.

9. A combined cap for a container for storing and dispensing products, comprising a flow-limiting device according to claim 1; and a cap comprising a closure element, wherein the flow-limiting device is attached to the cap.

10. The combined cap according to claim 9, wherein the cap further comprises a tamper-evident device.

11. The combined cap according to claim 9, wherein the closure element comprises a top plate and an annular sealing skirt depending therefrom; wherein the sealing skirt is shaped and arranged to form a moisture-tight seal with a sealing ring of the flow-limiting device.

12. The combined cap according to claim 9, wherein the closure element comprises a reservoir for receiving a dispensed unitary product.

13. The combined cap according to claim 9, wherein the cap further comprises a hinge for hingedly opening at least a part of the closure element of the cap.

14. A container for storing and dispensing unitary products comprising:

the combined cap according to claim 9, wherein the cap is openable;

a container body with a container opening to which the combined cap is mounted; wherein the dispensing opening is dimensioned to allow passage of one unitary product at a time.

15. The container according to claim 14, wherein the container opening is surrounded by a lip; and the lip is shaped to allow a snap-fit connection with either the cap or the flow-limiting device.

16. The flow-limiting device according to claim 7, wherein the elevated regions comprise ribs.

17. The combined cap according to claim 10, wherein the tamper-evident device comprises at least one tearable or frangible element.

18. The combined cap according to claim 11, wherein the closure element comprises a reservoir for receiving a dispensed unitary product, wherein the reservoir is delimited by the top plate and the annular sealing skirt.

* * * * *